US006644288B2

(12) United States Patent
Yamada

(10) Patent No.: US 6,644,288 B2
(45) Date of Patent: Nov. 11, 2003

(54) ENGINE

(75) Inventor: Naohisa Yamada, Inuyama (JP)

(73) Assignee: Yamada Mfg. Co., Ltd., Aichi-ken (JP)

( * ) Notice: Subject to any disclaimer, the term of this patent is extended or adjusted under 35 U.S.C. 154(b) by 0 days.

(21) Appl. No.: 09/858,563

(22) Filed: May 17, 2001

(65) Prior Publication Data

US 2002/0170543 A1 Nov. 21, 2002

(51) Int. Cl.[7] ..... F02M 37/04
(52) U.S. Cl. ..... 123/509; 123/508
(58) Field of Search ..... 123/508, 509, 123/463, 514, 495

(56) References Cited

U.S. PATENT DOCUMENTS 1,882,896 A * 10/1932 Redmond ..... 123/508
1,919,286 A * 7/1933 Woolson ..... 123/508
3,967,606 A * 7/1976 Perry ..... 123/459
4,170,205 A * 10/1979 Fiedler ..... 123/508
4,494,511 A * 1/1985 Ito ..... 123/463
5,323,750 A * 6/1994 Rotter ..... 123/508
5,488,933 A * 2/1996 Pham ..... 123/531
6,079,392 A * 6/2000 Matsuda ..... 123/458

FOREIGN PATENT DOCUMENTS

EP 0248411 * 12/1987 ..... 123/511

* cited by examiner

*Primary Examiner*—Carl S. Miller
(74) *Attorney, Agent, or Firm*—Rothwell, Figg, Ernst & Manbeck

(57) ABSTRACT

An engine has a fuel supply system comprising a fuel pump provided with valves for opening and closing a fuel suction hole and a fuel exhaust hole alternately, synchronously with a movement of an air supply push rod, a pipe connecting the fuel suction hole of the fuel pump and a fuel supply source to each other; and a pipe connecting the fuel exhaust hole of the fuel pump and a fuel injection device provided on an air supply port of the cylinder to each other, wherein a fuel is fed to the fuel injection device from the fuel pump owing to an upward movement and a downward movement of the air supply push rod caused by a rotation of the crankshaft; and the air supply valve is opened to inject the fuel.

25 Claims, 8 Drawing Sheets

ENGINE

BACKGROUND OF THE INVENTION

The present invention relates to a fuel supply apparatus of an internal combustion engine. More particularly, the present invention relates to an engine that can be used for a model airplane.

In the conventional fuel supply apparatus for supplying fuel to the combustion chamber of the engine which is used for the model airplane, the mixing of air and fuel is adjusted in a carburetor, and the mixture of the air and the fuel is fed to the cylinder from the air supply path. The amount of the fuel is adjusted by the needle valve of the carburetor.

In the conventional carburetor, a necessary amount of fuel is not supplied in correspondence to a large amount of air sucked into the carburetor when the number of rotations of the engine is increased rapidly from a small number of rotations thereof. That is, the air-fuel ratio is unbalanced.

Consequently, the rotation of the engine becomes non-uniform. Further the fuel is not supplied to the carburetor appropriately owing to a centrifugal force generated during flight of the model airplane. Therefore, the engine has a bad condition in its drive.

In the case where the fuel is injected at a position apart from the air supply valve, the fuel vaporizes before it is sucked into the carburetor and heat is robbed from the peripheral space. As a result, the air-fuel mixture gas expands and the volume efficiency deteriorates. When the fuel has entered the combustion chamber, it is impossible to cool the combustion chamber because the fuel has already vaporized. When the fuel is injected successively by using a gear pump or a plunger, the fuel is injected even when the valve is closed. In this case, there is a possibility that the fuel collects on the closed valve. In this case, when the valve is opened, the fuel which has collected on the closed valve may enter the combustion chamber. Consequently, the fuel does not vaporize appropriately. In the case where the gear pump or the plunger is used, the fuel is supplied according to the number of rotations of the engine. Therefore, as the number of rotations of the engine becomes higher, a supply pressure becomes increasingly high.

The present invention has been made to solve the problem. Therefore, it is a first object of the present invention to provide an engine having an improved response and allowing a combustion chamber to be cooled efficiently when fuel vaporizes.

It is a second object of the present invention to provide an engine having an improved response and allowing a combustion chamber to be cooled efficiently when a fuel vaporizes, by so constructing the engine that intermittent injection of a proper amount of fuel can be accomplished.

SUMMARY OF THE INVENTION

The first object described above is attained by an engine of a type in which an air supply valve of a cylinder is opened and closed by rotation of a crankshaft which is transmitted to an air supply cam and an air supply push rod. The engine has a fuel supply system comprising a fuel pump provided with valves for opening and closing a fuel suction hole and a fuel exhaust hole alternately, synchronously with a movement of an air supply push rod, a pipe connecting said fuel suction hole of said fuel pump and a fuel supply source to each other, and a pipe connecting said fuel exhaust hole of said fuel pump and a fuel injection device provided on an air supply port of the cylinder to each other, wherein a fuel is fed to said fuel injection device from said fuel pump owing to an upward movement and a downward movement of said air supply push rod caused by a rotation of said crankshaft; and said air supply valve is opened to inject said fuel.

Also, the first object described above is attained by an engine of a type in which an air supply valve of a cylinder is opened and closed by rotation of a crankshaft which is transmitted to an air supply cam and an air supply push rod. The engine comprises the cylinder having an air supply port, a fuel injection device provided on the air supply port of the cylinder, a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod, a lead valve for opening said fuel suction hole when the inside of said fuel pump chamber has the depressurized state, and a lead valve for opening said fuel exhaust hole when the inside of said fuel pump chamber has the pressurized state, a pipe connecting said fuel suction hole of said fuel pump and a fuel supply source to each other; and a pipe connecting said fuel exhaust hole of said fuel pump and said fuel injection device to each other.

The second objects described above is attained by an engine of a type in which an air supply valve of a cylinder is opened and closed by rotation of a crankshaft which is transmitted to an air supply cam and a air supply push rod for an air supply valve. The engine comprises a crankcase having an air supply pipe, the cylinder having an air supply port including an air-feeding pipe connected to an inside of said crankcase, a fuel injection device provided on the air supply port of the cylinder, a fuel pump having a valve for opening and closing a fuel suction hole and a fuel exhaust hole synchronously with a movement of said air supply push rod for said air supply valve, a pipe connecting a fuel suction hole of said fuel pump and a fuel supply source to each other, a fuel supply pipe connecting a fuel exhaust hole of said fuel pump and said fuel injection device to each other, and a fuel supply regulator provided in said fuel supply pipe to adjust an amount of a fuel in such a way that the higher an internal pressure of said crankcase or that of said air-feeding pipe is, the more an amount of said fuel becomes.

Also, the second objects described above is attained by an engine of a type in which an air supply valve of a cylinder is opened and closed by rotation of a crankshaft which is transmitted to an air supply cam and a air supply push rod for an air supply valve. The engine comprises a crankcase having an air supply pipe, the cylinder having an air supply port including an air-feeding pipe connected to an inside of said crankcase, a fuel injection device provided on the air supply port of the cylinder, a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod for said air supply valve, a lead valve for opening said fuel suction hole when the inside of said fuel pump chamber has the depressurized state, and a lead valve for opening said fuel exhaust hole when the inside of said fuel pump chamber has the pressurized state, a pipe connecting said fuel suction hole of said fuel pump and a fuel supply source to each other, a fuel supply pipe connecting said fuel exhaust hole of said fuel pump and said fuel injection device to each other, and a fuel supply regulator provided on said fuel supply pipe and having a diaphragm partitioning an inside of said fuel supply regulator into a primary side communicating with a fuel inflow port, a fuel outflow port, and a fuel return hole and a secondary side communicating with an inside of said crankcase or an inside of said air-feeding pipe and moving when there is a pressure fluctuation at said secondary side; and a valve, for said fuel return hole, capable of adjusting an open degree of said fuel return hole owing to a movement of said diaphragm in such a way that the higher a pressure at said secondary side, the lower the open degree of said fuel return hole becomes.

DETAILED DESCRIPTION OF THE PREFERRED EMBODIMENTS

Figure 1:
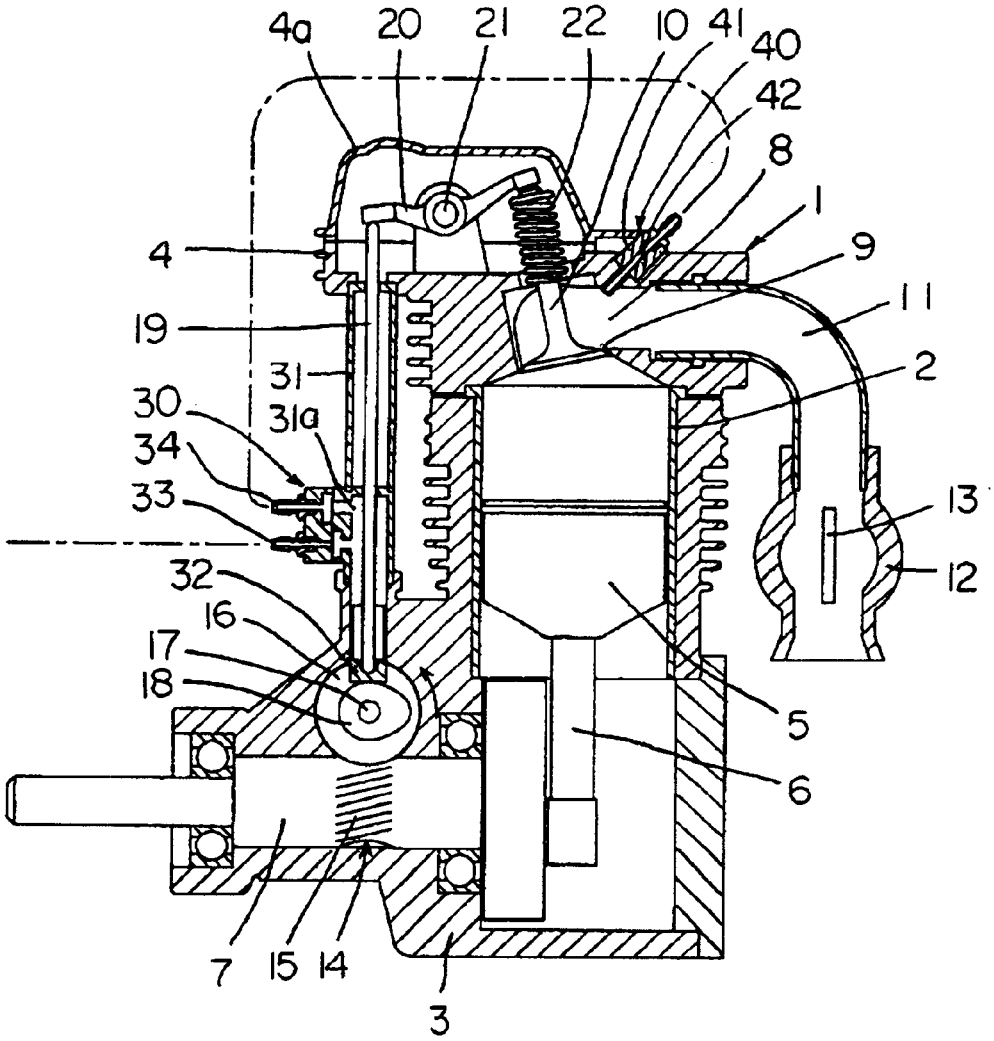
FIG. 1 is a sectional view showing an engine of an embodiment of the present invention.

The embodiments of the present invention will be described below with reference to the drawings.

The engine of a first embodiment of the present invention will be described below with reference to FIGS. 1 through 6.

The engine of the first embodiment is applied to a model airplane or the like of a four-cycle engine.

The engine of the present invention is of a type in which a cam rotated by rotation of a crankshaft 7 allows an air supply push rod and an exhaust push rod to move and thereby an air supply valve of a cylinder and an air exhaust valve thereof are opened and closed.

The engine 1 has a fuel supply system or mechanism. The engine 1 has a fuel injection device 40 disposed on an air supply port 8; a fuel pump 30 provided with valves 35, 36 for opening and closing a fuel suction hole 33 and a fuel exhaust hole 34 alternately synchronously with the movement of an air supply push rod 19; a pipe connecting the fuel suction hole 33 of the fuel pump 30 and a fuel supply source to each other; and a pipe connecting the fuel exhaust hole 34 of the fuel pump 30 and the fuel injection device 40 to each other. In the engine 1, fuel is fed to the fuel injection device 40 from the fuel pump 30 owing to an upward movement and a downward movement of the air supply push rod 19 caused by the rotation of the crankshaft 7. The air supply valve 10 is opened to inject the fuel in such a way that an intermittent injection of the fuel from the fuel injection device 40 is substantially synchronized with the opening and closing of the air supply valve 10.

The engine 1 includes the fuel injection device 40 disposed on the air supply port 8; the fuel pump 30 having a fuel pump chamber 31*a*, the fuel suction hole 33 and the fuel exhaust hole 34 both communicating with the fuel pump chamber 31*a*, a piston member 32 for setting the inside of the fuel pump chamber 31*a* to a pressurized state and a depressurized state according to the movement of the air supply push rod 19, a lead valve 35 for opening the fuel suction hole 33 when the inside of the fuel pump chamber 31*a* has the depressurized state, and a lead valve 36 for opening the fuel exhaust hole 34 when the inside of the fuel pump chamber 31*a* has the pressurized state; the pipe connecting the fuel suction hole 33 of the fuel pump 30 and the fuel supply source to each other; and the pipe connecting the fuel exhaust hole 34 of the fuel pump 30 and the fuel injection device 40 to each other. The piston member (cam follower) 32 sets the inside of the fuel pump chamber 31*a* to the pressurized state when the air supply push rod 19 operates and the air supply valve 10 opens.

In the engine 1, the distance between the fuel pump and the fuel injection device is short in the supply of the fuel. The engine 1 is effective because no fuel injection delay occurs when the air supply valve opens. The engine of the embodiment has the fuel pump which is operated by the movement of the air supply push rod or synchronously with the movement thereof. The fuel pump 30 has the fuel pump chamber 31*a*; the fuel suction hole 33 and the fuel exhaust hole 34 both communicating with the fuel pump chamber 31*a*; the valves 35, 36 for opening and closing the fuel suction hole 33 and the fuel exhaust hole 34 synchronously with the movement of the air supply push rod 19. Through the pipe, the fuel exhaust hole 34 of the fuel pump is connected to the fuel injection device 40 installed on the air supply port 8. In the engine of the embodiment, when the crankshaft 7 rotates and an air supply cam 18 pushes the air supply push rod 19 upward (at the time of upward movement), the inside of the fuel pump 30 has the pressurized (positive pressure) state. In this state, the valve 36 for the fuel exhaust hole 34 opens. As a result, fuel sucked (stored) in the fuel pump 30 is exhausted from the fuel exhaust hole 34 and fed to a fuel injection nozzle 42 of the fuel injection device 40. When the air supply push rod 19 is pushed upward, the air supply valve 10 opens. Consequently, the fuel injection device 40 injects the fuel fed to the fuel injection nozzle 42 into a combustion chamber of the cylinder through an air supply hole. When the air supply push rod 19 starts to move downward owing to a further rotation of the air supply cam 18, the air supply valve 10 closes, thus setting the inside of the fuel pump 30 to the depressurized state. Consequently, the valve 36 of the fuel exhaust hole 34 of the fuel pump 30 closes, whereas the valve 35 of the fuel suction hole 33 opens. As a result, the fuel flows into the fuel pump 30 from the fuel supply source. When the air supply push rod 19 is at the downward position and substantially stationary, the inside of the fuel pump is set to neither the pressurized state nor the depressurized state. Thus, the fuel is neither introduced to the fuel pump nor discharged therefrom. In the engine of the embodiment, owing to the opening and closing of the air supply valve caused by the upward and downward movement of the air supply push rod, the fuel is intermittently injected from the fuel injection nozzle by the action of the fuel pump which operates in unison with the upward and downward movement of the air supply push rod. Accordingly, it is possible to improve the response characteristic of the engine and cool the combustion chamber efficiently when the fuel vaporizes. Further the piston of the fuel pump can be constructed of the cam follower of the push rod. Thereby it is possible to simplify the construction of the engine and the fuel supply apparatus.

The engine 1 of the embodiment has a cylinder having an air supply port, an air supply valve, an exhaust port and an exhaust valve, a piston for the cylinder, an air supply cam rotated by rotation of the crankshaft, an air supply push rod driven by the air supply cam and for opening and closing the air supply valve, an exhaust cam rotated by rotation of the crankshaft and an exhaust push rod driven by the exhaust cam and for opening and closing the exhaust valve.

The engine 1 of the embodiment has a cylinder 2, a crankcase 3, a cylinder head 4 installed above the cylinder 2, and a head cover 4*a*. The engine 1 includes a piston 5, a connection rod 6, the crankshaft 7, and an air supply port 8 and an exhaust port (not shown) formed on the upper surface of the cylinder 2. An air supply hole 9 of the air supply port 8 is provided with the air supply valve 10 which can be opened and closed by an opening/closing means. The exhaust hole of the exhaust port is provided with an exhaust valve (not shown) and an exhaust pipe (not shown). The air supply port 8 is connected to an air-feeding pipe 11. The air-feeding pipe 11 is provided with a carburetor 12 accommodating a throttle 13 for adjusting the supply amount of air.

The mechanism for driving the air supply valve 10 and the exhaust valve is described below. The mechanism for driving the air supply valve 10 and the exhaust valve includes the crankshaft 7; a camshaft 17 to which the rotation of the engine 1 is decreasingly transmitted by a gear transmission mechanism 14 provided on the crankshaft 7; the air supply cam 18 and an exhaust cam both provided on the camshaft 17; the air supply push rod 19 driven upward and downward by the air supply cam 18; the exhaust push rod driven upward and downward by the exhaust cam; the air supply valve 10; an air supply locking arm (in other words, locking arm for the air supply valve) 20 driven by the air supply push rod 19 to open and close the air supply valve 10; the exhaust valve; and an exhaust locking arm driven by the exhaust push rod to open and close the exhaust valve. In the engine of the embodiment, the gear transmission mechanism 14 is constructed of a driving gear 15 of the crankshaft 7 and a driven gear 16, of the camshaft 17, engaging the driving gear 15 with a certain formed between the driving gear 15 and the driven gear 16. The gear transmission mechanism 14 transmits ½ of the number of rotations of the crankshaft 7 to the camshaft 17. Thus the camshaft 17 makes one rotation when the crankshaft 7 makes two rotations. The air supply cam 18 and the exhaust cam are installed on the camshaft 17, with a phase difference provided between the air supply cam 18 and the exhaust cam.

The opening/closing means for opening/closing the air supply valve 10 of the cylinder 2 has the locking arm 20, for opening and closing the air supply valve 10, disposed inside a head cover 4*a* of the cylinder head 4 and rotatably supported by a shaft 21; a contact portion disposed at one end of the locking arm 20 and contacting the air supply push rod 19; a contact portion disposed at the other end of the locking arm 20 and contacting the air supply valve 10 for opening and closing the air supply hole 9; and a spring 22 for pushing the other end of the locking arm 20 upward to always set the air supply valve 10 to a closed state. In the engine 1, with the rotation of the crankshaft 7, the air supply cam 18 rotates. The air supply push rod 19 and the locking arm 20 move in association with the rotation of the air supply cam 18. More specifically, the air supply push rod 19 disposed between the air supply cam 18 of the camshaft 17 and the locking arm 20 makes upward and downward movements owing to the rotation of the air supply cam 18 caused by the rotation of the crankshaft 7, thus operating the locking arm 20. Thereby the air supply valve 10 is opened and closed. Similarly to the air supply valve, the exhaust valve is opened and closed by the rotation of the camshaft through the exhaust cam, the air exhaust push rod, and the locking arm for the exhaust valve. Each of the air supply push rod and the air exhaust push rod is provided with a push rod cover disposed between the cylinder head disposed at the upper portion of the engine 1 and the crankcase disposed at the lower portion thereof. The mechanism for opening and closing the exhaust valve is not shown in the drawings.

The fuel supply mechanism of the engine of the embodiment applied to the four-cycle engine will be described below.

As the fuel supply mechanism or system, the engine has the fuel pump 30 provided with lead valves for opening and closing the fuel suction hole and the fuel exhaust hole alternately synchronously with the movement of the air supply push rod 19. The fuel exhaust hole of the fuel pump 30 and the fuel injection device 40 are connected to each other by the pipe. The rotating motion of the air supply cam 18 caused by the rotation of the crankshaft is converted into the upward and downward movement of the air supply push rod 19. Owing to the upward and downward movement of the air supply push rod 19, the fuel in the fuel pump 30 is sucked and exhausted intermittently. Thus the fuel injection device 40 sucks and exhausts the fuel synchronously with the opening and closing of the air supply valve 10.

As the fuel supply mechanism, the engine has the fuel pump 30 provided with the fuel suction hole 33 and the fuel exhaust hole 34; the pipe connecting the fuel suction hole 33 of the fuel pump and the fuel supply source to each other; and the pipe connecting the fuel exhaust hole 34 of the fuel pump and the fuel injection device 40 to each other.

The fuel pump 30 has the fuel pump chamber 31*a*; the fuel suction hole 33 and the fuel exhaust hole 34 both communicating with the fuel pump chamber 31*a*; the valves 35, 36 for opening and closing the fuel suction hole 33 and the fuel exhaust hole 34 synchronously with the movement of the air supply push rod 19; and the cam follower 32 fixed to the lower end of the air supply push rod 19 and constituting the piston member of the fuel pump.

As shown in FIG. 1, the engine 1 has the cylinder head 4 covering the upper part of the engine 1 at the side of the air supply valve, the spring 22, the upper part of the locking arm 20 and the air supply push rod 19; a cylindrical member 3*a* (see FIG. 2) formed integrally with the crankcase 3 at a side thereof; and a cylindrical push rod cover 31 whose upper end is fixed to the cylinder head 4 and whose lower end is fixed to the cylindrical member 3*a* of the crankcase 3.

More specifically, the fuel pump chamber 31*a* is constructed of the lower part of the push rod cover 31 and the cylindrical member 3*a* of the crankcase 3. The cam follower 32 slides liquid-tightly inside the fuel pump chamber, namely, inside the cylindrical member 3*a*. When the cam follower 32 moves upward, it sets the inside of the fuel pump chamber to the pressurized state. When the cam follower 32 moves downward, it sets the inside of the fuel pump chamber to the depressurized state. The push rod 19 is disposed at a substantially axial center of the push rod cover 31 and extends vertically through the push rod cover 31.

The fuel supply mechanism of the engine of the embodiment has a cylindrical part having a sliding permission sealing portion 31*b* through which the air supply push rod 19 extends and is slidable liquid-tightly; the piston member 32 provided on the air supply push rod 19 and slidable liquid-tightly inside the cylindrical part; the fuel suction hole 33 and the fuel exhaust hole 34 provided on the cylindrical part in such a way that the fuel suction hole 33 and the fuel exhaust hole 34 communicate with the fuel pump chamber 31*a* formed by the inner surface of the cylindrical part including the sliding permission sealing portion 31*b* and the piston member 32; the lead valve 35 for opening the fuel suction hole 33 when the inside of the fuel pump chamber 31*a* is set to the depressurized state; and the lead valve 36 for opening the fuel exhaust hole 34 when the inside of the fuel pump chamber 31*a* is set in the pressurized state. The cylindrical part is constructed of the lower part of the push rod cover 31 and the cylindrical member 3*a* of the crankcase 3. The piston member is constructed of the cam follower 32. The piston member may be formed on the push rod 19, separately from the cam follower 32. In this case, the cylindrical part can be formed of only the push rod cover.

Provided at the lower end of the push rod 19 is the cam follower 32 moving upward and downward inside the cylindrical member 3*a*, with the cam follower 32 in contact with the peripheral surface of the air supply cam 18. The upper end of the push rod 19 passes through a through-hole of the cylinder head 4 and is in contact with one end of the locking arm 20 disposed inside the head cover 4*a*. The lower end of the push rod 19 has a circular arc portion in correspondence to the shape of the inner surface of the lower part of the cam follower 32. The lower surface of the cam follower 32 is in contact with the air supply cam 18. The cam follower 32 moves upward and downward owing to the rotation of the air supply cam 18. Thereby the pump sucks and exhausts fuel.

In the fuel pump chamber 31*a* of the engine 1, the inside of the cylindrical push rod cover 31 is partitioned, with the annular rib 31*b* projecting inward. Thus the lower part of the cylindrical push rod cover 31 and the cylindrical member 3*a* of the crankcase 3 form the fuel pump chamber 31*a* which sucks and exhausts the fuel. The push rod 19 slides in contact with the inner surface of the annular rib 31*b* almost liquid-tightly.

The fuel pump 30 has the lead valve 35 which opens when the inside of the fuel pump chamber 31*a* is set to the depressurized state (in other words, when the push rod 19, namely, the cam follower 32 moves downward), thus allowing the fuel to be supplied thereto from the fuel suction hole 33; and the lead valve 36 which opens when the inside of the fuel pump chamber 31*a* is set to the pressurized state (in other words, when the push rod 19, namely, the cam follower 32 moves upward), thus allowing the fuel to be exhausted from the fuel exhaust hole 34.

The fuel suction hole 33 of the fuel pump 30 is connected to a fuel tank (not shown) of the fuel supply source. The fuel exhaust hole 34 is connected to the fuel injection device 40. A pipe connection tool is installed on each of the fuel suction hole 33 and the fuel exhaust hole 34. The lead valve 35 is installed on the inner side of the fuel suction hole 33 in such a way that the lead valve 35 opens inward (in other words, the lead valve 35 opens at the depressurized time). The lead valve 36 is installed on the inner side of the fuel exhaust hole 34 in such a way that the lead valve 36 opens outward (in other words, the lead valve 36 opens at the pressurized time). Thus owing to the upward and downward movement of the cam follower (piston in the fuel pump chamber) 32, the lead valve 35 for the fuel suction hole and the lead valve 36 for the fuel exhaust hole open and close alternately.

More specifically, when the cam follower 32 moves downward owing to the rotation of the air supply cam 18, the exhaust-side lead valve 36 closes owing to the sucking force of the cam follower 32, whereas the suction-side lead valve 35 opens. Thus the fuel pump 30 sucks the fuel from the fuel tank. When the cam follower 32 moves upward owing to the rotation of the air supply cam 18, the suction-side lead valve 35 closes owing to the pressing force of the cam follower 32, whereas the exhaust-side lead valve 36 opens. Thus the fuel stored in the fuel pump chamber is fed to the fuel injection device 40. The inside of the cylindrical push rod cover 31 is partitioned into the lower part and the upper part with the annular rib 31*b* to form the lower part as a part of the fuel pump chamber and the upper part as an air chamber. It is preferable to partition the inside of the cylindrical push rod cover 31 in such a manner that the fuel does not leak therefrom. In the embodiment, the lead valve is provided for the fuel sucking hole and the fuel exhaust hole of the fuel pump. But a valve which is urged by a spring may be provided for the fuel sucking hole and the fuel exhaust hole to open and close the valve, according to sucking and exhausting operation of the pump.

Figure 2:
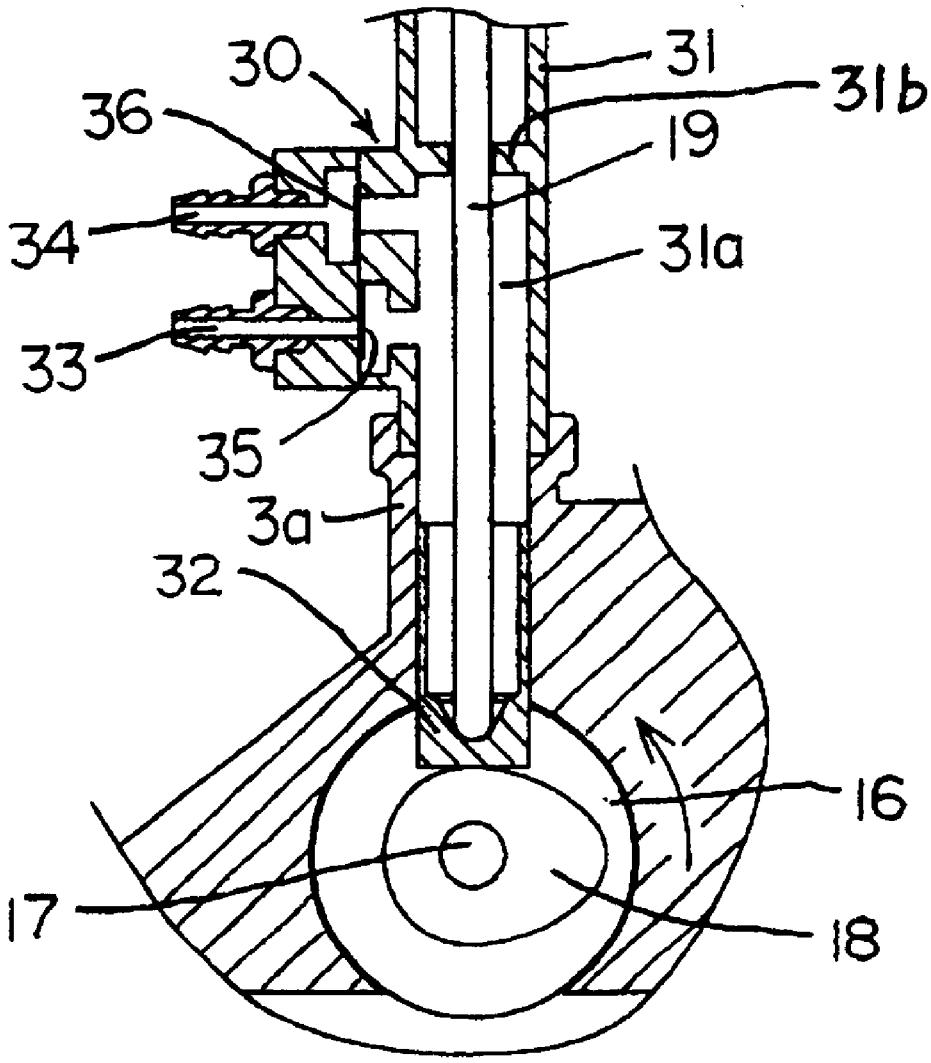
FIG. 2 is a main part-enlarged sectional view showing the engine shown in FIG. 1.
Figure 3:
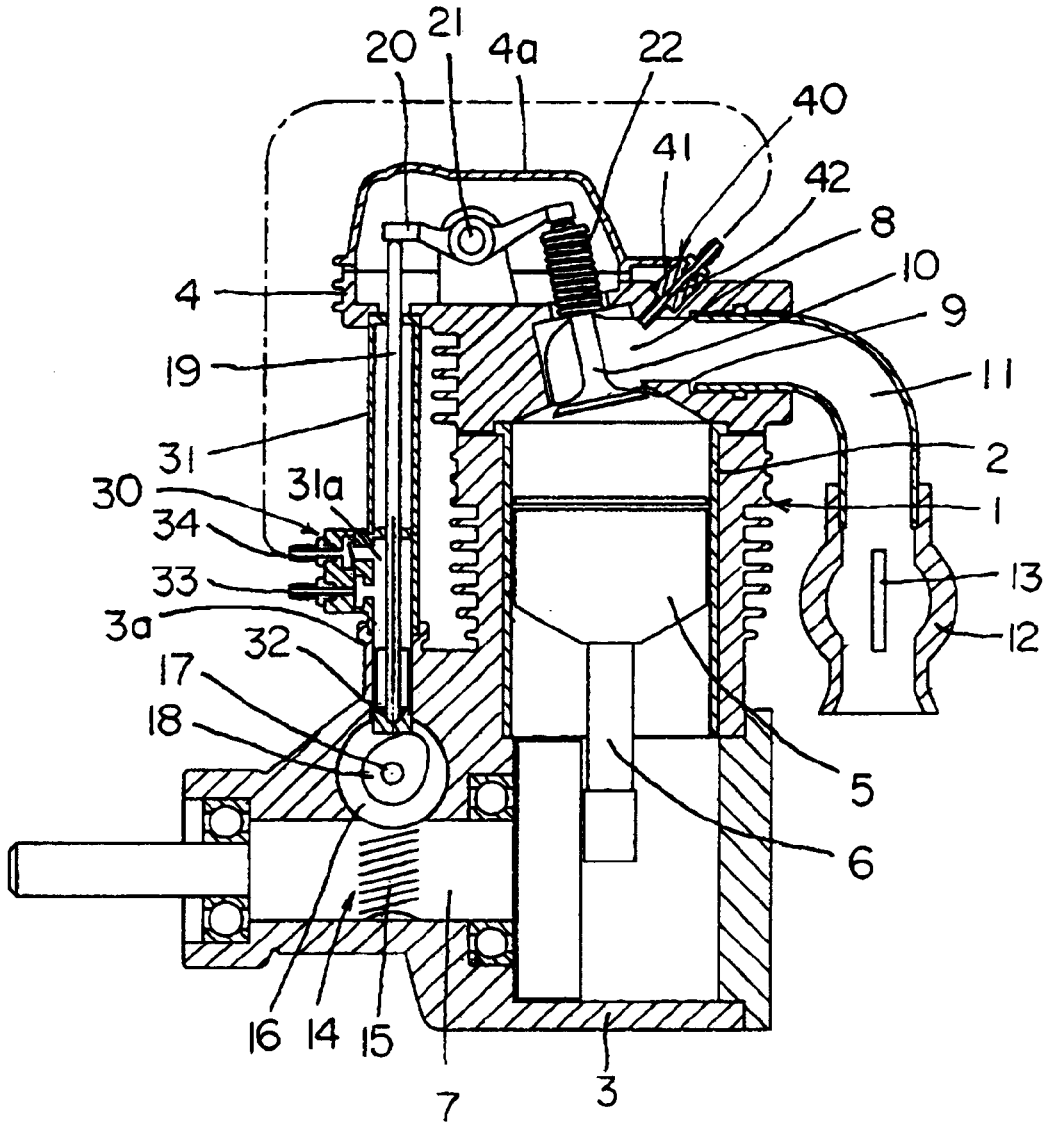
FIG. 3 is a sectional view showing a state in which an air supply valve of the engine shown in FIG. 1 is opened for fuel injection.
Figure 4:
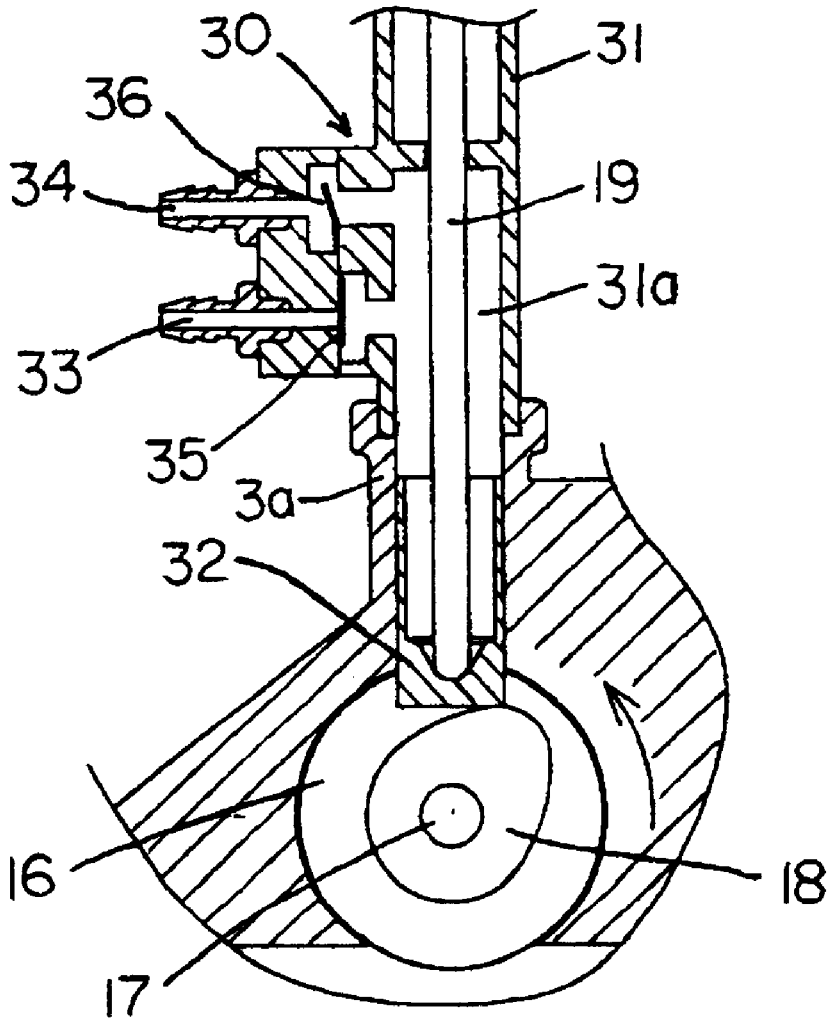
FIG. 4 is a main part-enlarged sectional view showing a state in which an exhaust valve of a fuel pump of the engine shown in FIG. 1 is opened and a suction valve is closed.

In the engine shown in FIGS. 1 through 3, the fuel injection device 40 is installed on the air supply port 8 disposed over the cylinder 2 in such a way that the fuel injection device 40 is disposed above the air supply valve 10 and faces it obliquely. The fuel injection device 40 has a body 41 and the fuel injection nozzle 42. The fuel injection device 40 is installed on the air supply port 8 of the cylinder 4 in such a way that the fuel injection nozzle 42 faces the air supply valve 10 obliquely. As described above, the pipe connects the fuel injection device 40 to the fuel exhaust hole 34 of the fuel pump 30. Owing to the rotation of the air supply cam 18 caused by the rotation of the crankshaft 7, the fuel injection device 40 is capable of intermittently injecting the fuel sucked (stored) in the fuel pump chamber 31*a* of the fuel pump 30. The engine is used when the fuel is filled inside of the fuel pump chamber 31*a*, the pipe connecting the fuel injection device and the fuel exhaust hole of the fuel pump 30 to each other, and the pipe connecting the fuel supply source and the fuel suction hole of the fuel pump 30 to each other, with no air substantially contained therein.

The operation of the fuel supply to be performed in the engine of the present invention shown in FIGS. 1 through 6 will be described below. FIGS. 1 and 2 show a state in which the fuel is not injected from the fuel injection nozzle 42, with the air supply valve 10 of the engine closed, namely, a state in which the lead valves 35, 36 of the fuel pump 30 are closed, with the larger diameter of the air supply cam 18 being substantially horizontal. In this state, the fuel (not shown) is sucked into the fuel pump 30. Upon rotation of the crankshaft 7 from the state shown in FIG. 2 to the state shown in FIGS. 3 and 4, the camshaft 17 rotates through the gear transmission mechanism 14, and the air supply cam 18 rotates. As a result, the side surface of the larger-diameter portion of the air supply cam 18 moves the cam follower 32 upward. Owing to the upward movement of the cam follower 32, the push rod 19 moves upward. The push rod 19 which has moved upward pushes the one end of the locking arm 20 against the urging force of the spring 22. As a result, the other end of the locking arm 20 moves downward, thus pressing the air supply valve 10 downward. Consequently, the air supply hole 9 starts to open, and the lead valve 36 for the fuel exhaust hole 34 disposed inside the fuel pump chamber 31*a* opens. As a result, the fuel injection nozzle 42 of the fuel injection device 40 injects the fuel stored inside the fuel pump chamber 31*a*. The fuel and air are sucked into the cylinder through the opened air supply hole 9.

Figure 5:
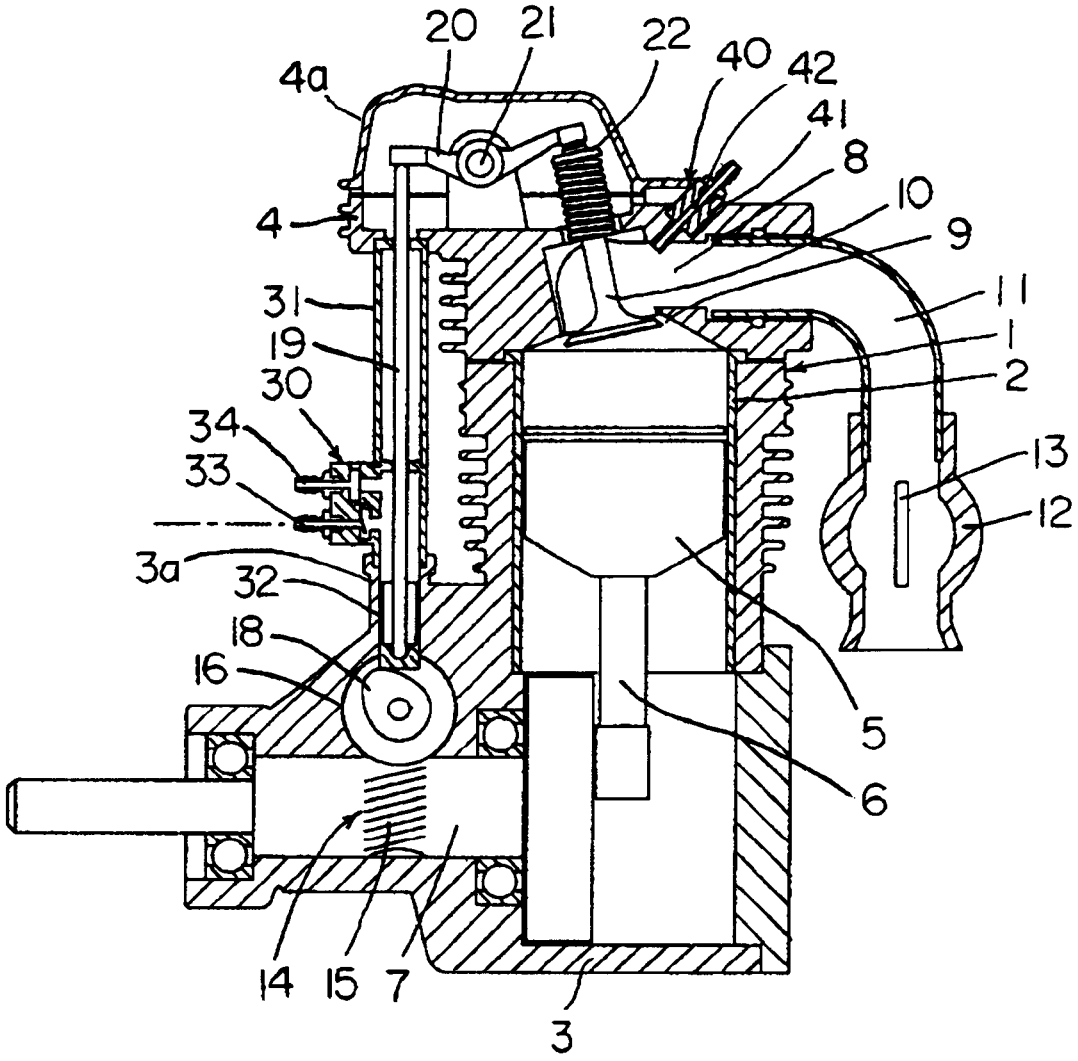
FIG. 5 is a sectional view showing a state in which the air supply valve of the engine shown in FIG. 1 is closed to stop fuel injection.
Figure 6:
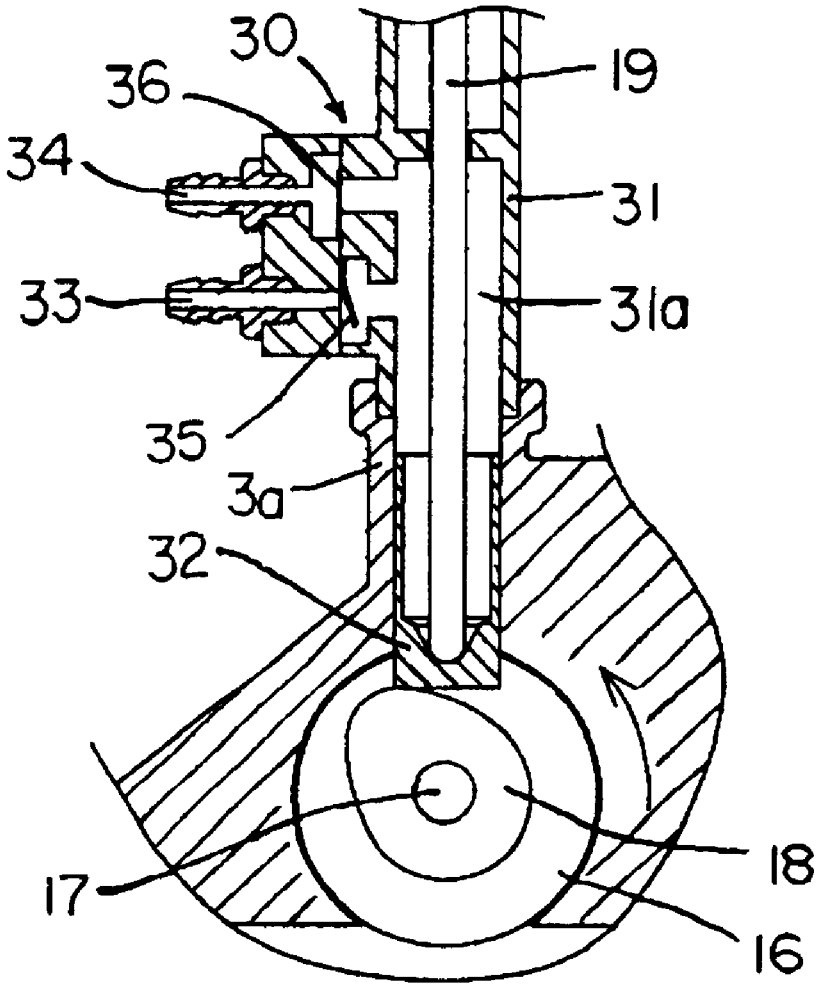
FIG. 6 is a main part-enlarged sectional view showing a state in which the suction valve of the fuel pump of the engine shown in FIG. 1 started to close.

Upon termination of the suction stroke of the fuel as shown in FIGS. 5 and 6, the air supply cam 18 rotates owing to the rotation of the crankshaft, and the cam follower 32 contacts the side surface of the smaller-diameter portion of the air supply cam 18. Thus the push rod 19 moves downward. The air supply valve 10 is closed by the restoring force of the spring 22. Owing to the downward movement of the push rod 19 and the cam follower 32, the lead valve 36 for the fuel exhaust hole 34 closes, whereas the lead valve 35 for the fuel suction hole 33 opens. Consequently the fuel is sucked into the fuel pump chamber 31*a*. The engine of the present invention has the above-described operation. Accordingly, owing to the rotation of the cam caused by the rotation of the crankshaft of the engine, the fuel can be intermittently injected by alternately opening and closing the suction-side valve of the fuel pump and the exhaust-side valve thereof.

An engine of an another embodiment of this invention shown in FIGS. 7 through 9 will be described below.

Similarly to the above-described engine 1, an engine 51 of this embodiment is of a type in which the rotation of the crankshaft allows the air supply valve of the cylinder to be opened and closed through the air supply cam and the air supply push rod.

An engine 51 has a crankcase 53 having an air supply pipe 62; the air supply port 8 having an air-feeding pipe 61 connected to the inside of the crankcase 53 and the fuel injection device 40; the fuel pump 30 having the valve for opening and closing the fuel suction hole 33 and the fuel exhaust hole 34 synchronously with the movement of the push rod 19 for the air supply valve; the pipe connecting the fuel suction hole 33 of the fuel pump 30 and the fuel supply source to each other; the fuel supply pipe connecting the fuel exhaust hole 34 of the fuel pump 30 and the fuel injection device 40 to each other; and a fuel supply regulator 70 provided in the fuel supply pipe to adjust the amount of fuel in such a way that the higher the internal pressure of the crankcase 53 or that of the air-feeding pipe 61 is, the more the amount of the fuel becomes.

The engine 51 of the embodiment has the crankcase 53 having the air supply pipe 62; the air supply port 8 having the air-feeding pipe 61 connected to the inside of the crankcase 53 and the fuel injection device 40; the fuel pump 30 having the valves 35, 36 for opening and closing the fuel suction hole 33 and the fuel exhaust hole 34 synchronously with a movement of the push rod 19 for the air supply valve; the pipe connecting the fuel suction hole 33 of the fuel pump 30 and the fuel supply source to each other; and the fuel supply pipe connecting the fuel exhaust hole 34 of the fuel pump 30 and the fuel injection device 40 to each other. The fuel supply pipe has the fuel supply regulator 70 having a diaphragm 72 partitioning the inside of the fuel supply regulator into a primary side 71*a* communicating with a fuel inflow port 73, a fuel outflow port 74, and a fuel return hole 75 and a secondary side 71*b* communicating with the inside of the crankcase 53 or the inside of the air-feeding pipe 61 and moving when there is a pressure fluctuation at the secondary side 71*b*; and a valve, for the fuel return hole, capable of adjusting the open degree of the fuel return hole 75 owing to the movement of the diaphragm 72 in such a way that the higher the pressure at the secondary side 71*b*, the lower the open degree of the fuel return hole 75 becomes. In the engine 51 of the embodiment, when the pressure at the secondary side 71*b* is higher than that of the primary side 71*a* by more than a predetermined value, the fuel return hole 75 is closed by the diaphragm 72 of the fuel supply regulator 70 and the valve 76, for the fuel return hole 75, thereof.

Figure 7:
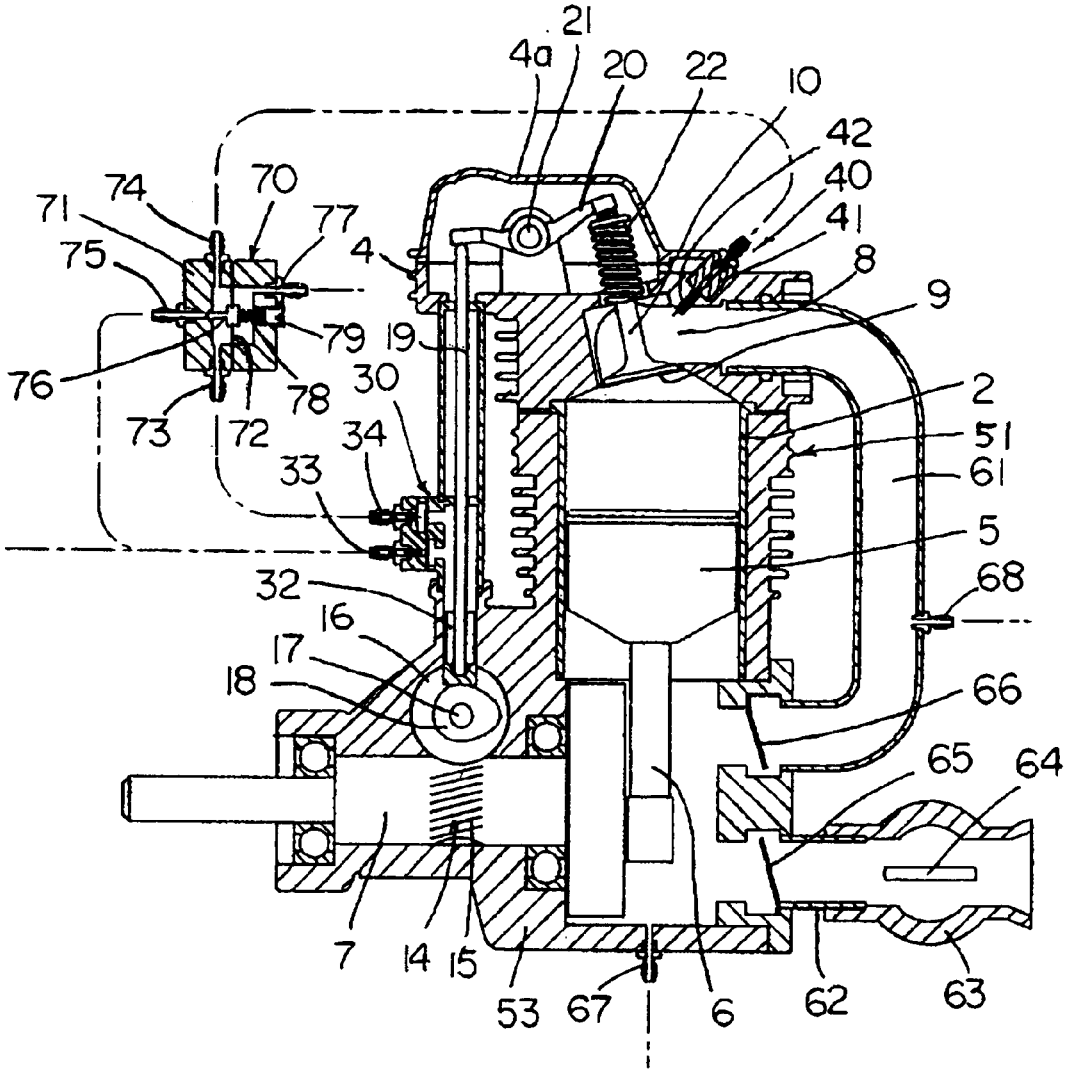
FIG. 7 is a sectional view showing an engine of another embodiment of the present invention.
Figure 8:
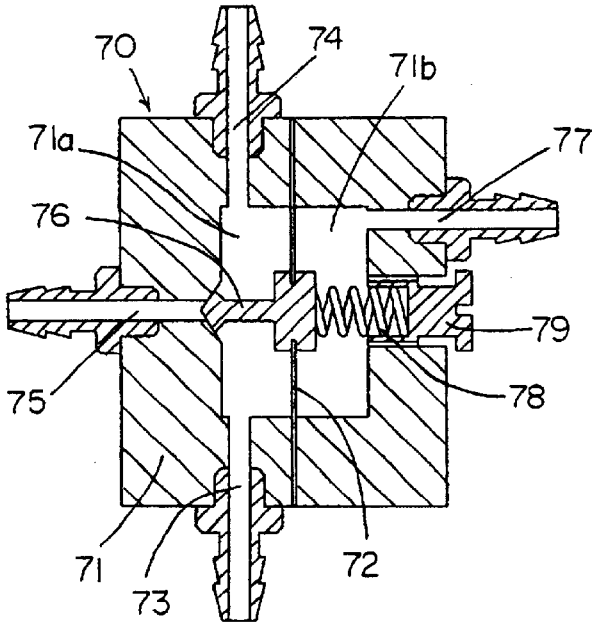
FIG. 8 is a sectional view showing a state in which a fuel return hole of a fuel control regulator for use in the engine shown in FIG. 7 is closed.
Figure 9:
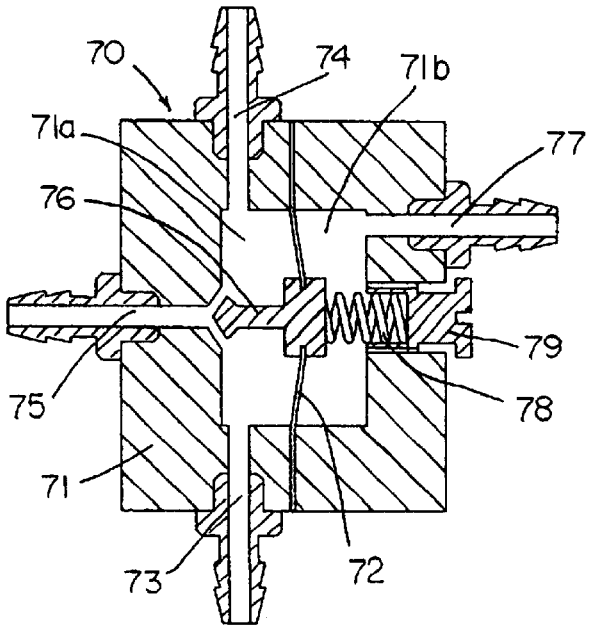
FIG. 9 is a sectional view showing a state in which a fuel return hole of a fuel control regulator for use in the engine shown in FIG. 7 is opened.

As shown in FIGS. 7, 8 and 9, the engine 51 of the embodiment has the fuel supply regulator 70.

Unlike the engine 1, the engine 51 of the embodiment is of a type in which air is introduced into the crankcase 53, has the air-feeding pipe 61 connecting the crankcase 53 and the air supply port 8 disposed over the cylinder to each other, and has the fuel supply regulator 70. The engine 51 is similar to the engine 1 in its other constructions including the driving mechanism such as the camshaft rotated by the rotation of the crankshaft, the gear transmission mechanism, the cam, the push rod, and the locking arm; the air supply valve 10; the opening/closing mechanism of the valve; the fuel pump 30; and the fuel injection device 40. Therefore, refer to the description made above for the description thereof.

As shown in FIG. 7, the engine 51 of the embodiment has the air-feeding pipe 61 connecting the crankcase 53 disposed at the lower portion of the engine and the air supply port 8 disposed over the cylinder to each other. The crankcase 53 has the air supply pipe 62 having the carburetor 63 accommodating the throttle 64. The amount of the air which is supplied by the air supply pipe 62 can be adjusted by the throttle 64. A lead valve 65 for opening and closing the air supply pipe 62 of the crankcase 53 is installed on the crankcase 53 at a position where the air supply pipe 62 is installed. A lead valve 66 for opening and closing the entrance of the air-feeding pipe 61 of the crankcase 53 is installed at the open portion of the air-feeding pipe 61 of the crankcase 53.

When the piston 5 moves upward, the inside of the crankcase 53 has a depressurized state. Consequently the lead valve 65 of the air supply pipe 62 opens, whereas the lead valve 66 of the air-feeding pipe 61 closes. As a result, air flows into the crankcase 53 from the air supply pipe 62. When the piston 5 moves downward (in sucking stroke), the inside of the crankcase 53 has the pressurized state. Consequently the lead valve 65 closes, and the lead valve 66 located at the entrance of the air-feeding pipe 61 opens. Thereby, the air inside the crankcase 53 is fed through the air-feeding pipe 61. The air fed through the air-feeding pipe 61 is supplied to the combustion chamber of the cylinder through the opened air supply valve 10 and mixed with fuel injected from the fuel injection nozzle 42 of the fuel injection device 40. The mixture of the air and the fuel is compressed in the compression stroke, ignited, exploded, and exhausted.

The crankcase 53 has a pressure hole 67. The air-feeding pipe 61 has a pressure hole 68. The pressure hole 67 is formed on the bottom of the crankcase 53. The pressure hole 67 is used to obtain a pressure signal of the crankcase 53. The pressure hole 68 formed on the air-feeding pipe 61 is used to obtain a pressure signal of the air-feeding pipe 61. The fuel supply regulator 70 is responsive to the pressure of the crankcase 53 or that of the air-feeding pipe.

In the air-introducing four-cycle engine or the two-cycle engine, at a rapid acceleration or a rapid deceleration, there is a case in which a necessary amount of fuel is not supplied in correspondence to the number of rotations of the engine. To compensate that, it is necessary to make the supply amount of the fuel to be fed to the fuel pump correspondent (favorably, proportional) to the internal pressure of the crankcase or that of the air-feeding pipe. As shown in FIG. 7, in the engine 51, the fuel control regulator 70 which is affected by the pressure of crankcase 53 or that of the air-feeding pipe 61 is provided between the fuel pump 30 and the fuel injection device 40.

In the engine 51 of the embodiment, owing to the upward and downward movement of the air supply push rod 19 caused by the rotation of the crankshaft 7, the intermittent fuel injection of the fuel injection device 40 is synchronous with the opening and closing of the air supply valve 10. Using the internal pressure of the crankcase or that of the air-feeding pipe, the fuel control regulator 70 executes control (preferably, proportional control) of the fuel supply amount in correspondence to the internal pressure. Thus it is possible to supply an appropriate amount of fuel.

The fuel supply regulator 70 has the diaphragm 72 partitioning the inside of its body 71 into the primary side 71*a* and the secondary side 71*b*; the fuel inflow port 73 formed at the primary side 71*a* of the body 71 and connected to the fuel pump chamber 31*a*; the fuel outflow port 74 formed at the primary side 71*a* of the body 71 and connected to the fuel injection device 40; the fuel return hole 75 formed at the primary side 71*a* of the body 71 and connected to the upstream side (upstream side with respect to the fuel suction hole 33) of the fuel pump 30; the valve 76, for the fuel return hole, formed on the diaphragm 72 to adjust the open degree of the fuel return hole 75; and a pressure hole 77, formed at the secondary side 71*b*, for transmitting the pressure of the crankcase 53 or that of the air-feeding pipe 61. The pressure hole 77 of the regulator 70 is connected to the pressure hole 67 of the crankcase 53 or the pressure hole 68 of the air-feeding pipe 61 by a pipe or tube.

The regulator 70 has a spring 78 for always urging the valve 76 for the fuel return hole 75 toward the fuel return hole 75. Further, the diameter of the front end surface of the front portion of the valve 76 for the fuel return hole is reduced gradually toward its front end. In correspondence to this construction, the diameter of the inner-side opening of the body of the fuel return hole 75 increases gradually toward the inner side (primary side) of the body of the fuel return hole 75. The open degree of the fuel return hole 75 is adjusted by the degree of proximity of the front end of the valve 76 for the fuel return hole to an inclined opening of the fuel return hole 75.

In the engine of the embodiment, the pressure hole 77 is connected to the pressure hole 67 of the crankcase 53. Therefore, the pressure of the secondary side of the diaphragm 72 is equal to the pressure inside the crankcase 53. Consequently, the diaphragm 72 is moved by a pressure fluctuation at the secondary side. As the pressure at the secondary side becomes higher, the front end of the valve for the fuel return hole becomes increasingly near to the open portion of the fuel return hole 75, and the open degree of the fuel return hole 75 becomes increasingly low. The lower the open degree of the fuel return hole 75 becomes, the smaller the return amount of the fuel becomes. When the pressure of the secondary side 71*b* of the regulator 72 becomes higher than that of the primary side 71*a* (internal pressure of crankcase) by more than a predetermined value, the front end of the valve 76 for the fuel return hole contacts the fuel return hole 75 closely and closes the fuel return hole 75 substantially. When the pressure at the secondary side 71*b* of the regulator 72 becomes low, the diaphragm moves, and the valve 76 for the fuel return hole moves away from the fuel return hole 75. Thus the open degree of the fuel return hole 75 becomes higher (in other words, fuel conversion amount increases). The pressure hole 77 may be connected to the pressure hole 68 of the air-feeding pipe 61.

A spring-receiving screw member 79 is screwed to the body 71 as a means for adjusting the pressure of the spring 78 pressing the fuel return valve 76 in the direction in which the fuel return valve 76 is closed. The spring 78 is accommodated in a concave portion of the screw member 79. The spring 78 is always in contact with the base portion of the valve disposed at the center of the diaphragm to allow the spring pressure to be adjusted according to a tightening degree of the screw member 79. More specifically, in the engine of the embodiment, the pressure of the spring 78 at the fuel tank side (primary side) is set greater than the pressure thereof at the crankcase side (secondary side) to set the valve for the fuel return hole to an open state, when the engine is in a steady state. A pipe-connecting tool is mounted on each of the sucking hole, exhaust hole, return hole, and pressure hole of the regulator 70.

In the regulator which is used in the embodiment, the valve is installed at one side of the diaphragm, whereas the spring for adjusting position of the valve is installed at the other side of the diaphragm. Therefore, an optimum position at which the primary side is balanced with the secondary side can be determined easily by adjusting the degree of hardness of the spring. In the regulator which is used in the embodiment, the valve 76 has a base portion provided at a center of the diaphragm 72 and a valve portion projecting from the base portion toward the fuel return hole 75. The spring 78 contacts to the base portion and urges the base portion toward the fuel return hole 75.

The application of the engine of the present invention is not limited to four-cycle engine. The engine of the present invention is applicable to a two-cycle engine or the like in which air is introduced into the crankcase of an internal combustion engine.

With reference to FIGS. 8 and 9, the engine of the present invention having the fuel supply regulator will be further described below.

Similarly to the engine 1 described previously, in the engine 51 of the embodiment applied to a four-cycle engine, the fuel suction hole 33 and the fuel exhaust hole 34 are opened and closed by the lead valves 35 and 36, respectively synchronously with the movement of the air supply push rod 19, and the fuel sucked (stored) in the fuel pump chamber is injected from the fuel injection device 40. In the engine 51 of the embodiment, when the air supply push rod 19 is pushed upward owing to the rotation of the crankcase caused by the rotation of the air supply cam 18, the air supply valve 10 opens, and the lead valve 36 for the fuel exhaust hole 34 in the fuel pump 30 also opens, thus injecting the fuel to the fuel injection device 40. In this manner, the fuel and air are sucked into the combustion chamber of the cylinder. When the air supply push rod 19 starts to move downward owing to a further rotation of the air supply cam 18, the air supply valve 10 closes. Consequently, the valve 36 of the fuel exhaust hole 34 of the fuel pump 30 closes, whereas the valve 35 of the fuel suction hole 33 opens. As a result, the fuel flows into the fuel pump 30.

In the fuel supply mechanism of the engine of the embodiment, the fuel pump 30 is connected to the fuel injection device 40 through the fuel control regulator 70 which performs proportional control of fuel in correspondence to the pressure inside the crankcase 53 (or air-feeding pipe). Therefore, when the fuel is sucked and exhausted by operating the fuel pump owing to the upward and downward movement of the air supply push rod 19 caused by the rotation of the crankshaft, the fuel control regulator 70 executes substantial proportional control, according to the difference between the pressure of air introduced into the crankcase 53 and the pressure of the fuel fed to the fuel injection device 40 from the fuel pump. In the proportional control, excess fuel is returned to the upstream side of the fuel pump 30 to allow a proper amount of fuel to be intermittently injected from the fuel injection device 40 to the combustion chamber of the cylinder. Accordingly, it is possible to improve the response characteristic of the engine and cool the combustion chamber efficiently when the fuel vaporizes.

More specifically, in the engine, the fuel control regulator makes the proportional control in such a way that excess fuel is returned to the upstream side of the fuel pump from the fuel-sucking hole of the fuel pump. When the number of rotations of the engine increases rapidly, the pressure in the crankcase and that in the air-feeding pipe rise and thus the pressure at the secondary side of the regulator rises. Consequently, owing to the movement of the diaphragm, the valve for the fuel return hole reduces the open degree of the fuel return hole. Depending on a case, the fuel return hole is closed by the valve for the fuel return hole. Consequently, much of the whole fuel which has been fed owing to the movement of the cam follower which is the piston member of the fuel pump is fed to the fuel injection device. That is, in the fuel supply mechanism, the supply amount of the fuel can be increased automatically when the number of rotations of the engine increases and a large number of rotations thereof is required to be kept, i.e., when it is necessary to feed more fuel to the fuel injection device.

That is, when the engine is in a steady state, the fuel pump side of the fuel supply regulator of the engine has a pressure equal to or higher than that at the crankcase side thereof, and the valve 76 for the fuel return hole 75 is open. Thus a part of the fuel can return to the upstream side with respect to the fuel return hole 75 through the fuel return hole 75. Therefore, the whole amount of the fuel to be fed owing to the movement of the cam follower which is the piston member of the fuel pump is not fed to the fuel injection device, but excess fuel is returned to the upstream side with respect to the fuel return hole 75. When the throttle of the engine is opened for a rapid acceleration, a large amount of air is supplied and an air pressure rises. To supply a necessary amount of fuel in correspondence to the amount of air, the secondary side of the fuel control regulator is connected to the crankcase or the air-feeding pipe. With increase of the amount of air, the internal pressure of the crankcase and that of the air s-feeding pipe rise. Thereby the pressure at the secondary side of the fuel control regulator rises. As a result, the diaphragm is pressed toward the primary side and presses the valve 76 for the fuel return hole 75 in cooperation with the action of the spring 78, thus reducing the open degree of the fuel return hole 75. With the decrease of the open degree of the fuel return hole 75, of the amount of the fuel fed owing to the movement of the cam follower which is the piston member of the fuel pump, the amount of the fuel which is returned from the fuel return hole is small. That is, a large amount of the fuel is fed to the fuel injection device. Accordingly, it is possible to inject the fuel in an amount corresponding to the large amount of air and mix the fuel and the air with each other. Thus combustion suitable for a high-speed rotation of the engine can be accomplished.

When the throttle of the engine is closed to decelerate the engine, the internal pressure (air pressure) at the crankcase side and that at the air-feeding pipe side fall. At the same time, the pressure at the secondary side of the diaphragm 72 falls. Thus the diaphragm 72 is pressed toward the secondary side against the urging force of the spring. As a result, the valve 76, of the regulator, for the fuel return hole 75 moves away from the fuel return hole 75, and the open degree of the fuel return hole 75 becomes high. Thus the amount of the fuel which is returned through the fuel return hole 75 becomes great. In a short time, the engine returns to the normal state. Without the regulator, the throttle valve is closed, with the engine speed kept high. In this case, the fuel is supplied although the amount of air is not introduced into the throttle. Thus there is a possibility that the fuel collects on the air supply port. However, in the embodiment, the engine returns automatically to the normal state in which excess fuel is returned to the upstream side of the fuel pump 30. Thus it is possible to prevent the fuel from collecting on the air supply port and thus supply an appropriate amount of fuel.

What is claimed is:

1. An engine of a type in which an air supply valve of a cylinder is opened and closed by rotation of a crankshaft which is transmitted to an air supply cam and an air supply push rod, said engine comprising:

the cylinder having an air supply port;

a fuel injection device provided on the air supply port of the cylinder;

a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod, a lead valve for opening said fuel suction hole when the inside of said fuel pump chamber has the depressurized state, and a lead valve for opening said fuel exhaust hole when the inside of said fuel pump chamber has the pressurized state;

a pipe connecting said fuel suction hole of said fuel pump and a fuel supply source to each other;

a pipe connecting said fuel exhaust hole of said fuel pump and said fuel injection device to each other;

an air supply valve provided on the air supply port of the cylinder;

an exhaust port provided on the cylinder, an exhaust valve provided on the exhaust port of the cylinder;

a piston for the cylinder;

an air supply cam rotated by rotation of the crankshaft, the air supply push rod driven by the air supply cam and for opening and closing the air supply valve;

an exhaust cam rotated by rotation of the crankshaft and an exhaust push rod driven by the exhaust cam and for opening and closing the exhaust valve; and wherein said piston member sets the inside of said fuel pump chamber to the pressurized state when said air supply push rod operates and said air supply valve opens.

2. An engine according to claim 1, further comprising a cylindrical part having a sliding permission sealing portion in which said air supply push rod extends and is slidable liquid-tightly, wherein said piston member is provided on said air supply push rod; said fuel pump chamber is formed by an inner surface of said cylindrical part including said sliding permission sealing portion and said piston member; and said fuel suction hole and said fuel exhaust hole are provided on said cylindrical part in such a way that said fuel suction hole and said fuel exhaust hole communicate with said fuel pump chamber.

3. An engine according to claim 2, wherein said piston member is constructed of a cam follower provided at a lower end of said air supply push rod.

4. An engine according to claim 1, wherein said engine is a model airplane engine.

5. An engine of a type in which an air supply valve of a cylinder is opened and closed by rotation of a crankshaft which is transmitted to an air supply cam and an air supply push rod for an air supply valve, said engine comprising:

a crankcase having an air supply pipe;

the cylinder having an air supply port including an air-feeding pipe connected to an inside of said crankcase;

a fuel injection device provided on the air supply port of the cylinder;

a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod for said air supply valve, a lead valve for opening said fuel suction hole when the inside of said fuel pump chamber has the depressurized state, and a lead valve for opening said fuel exhaust hole when the inside of said fuel pump chamber has the pressurized state;

a pipe connecting said fuel suction hole of said fuel pump and a fuel supply source to each other;

a fuel supply pipe connecting said fuel exhaust hole of said fuel pump and said fuel injection device to each other;

a fuel supply regulator provided on said fuel supply pipe and having a diaphragm partitioning an inside of said fuel supply regulator into a primary side communicating with a fuel inflow port, a fuel outflow port, and a fuel return hole and a secondary side communicating with an inside of said crankcase or an inside of said air-feeding pipe and moving when there is a pressure fluctuation at said secondary side; and a valve, for said fuel return hole, capable of adjusting an open degree of said fuel return hole owing to a movement of said diaphragm in such a way that the higher a pressure at said secondary side, the lower the open degree of said fuel return hole becomes; and wherein said piston member sets the inside of said fuel pump chamber to the pressurized state when said push rod for an air supply valve operates and said air supply valve opens.

6. An engine according to claim 5, wherein when a pressure at said secondary side is higher than that of said primary side by more than a predetermined value, said fuel return hole is closed by said valve for said fuel return hole.

7. An engine according to claim 5, wherein further comprises an air supply valve provided on the air supply port of the cylinder, an exhaust port provided on the cylinder, an exhaust valve provided on the exhaust port of the cylinder, a piston for the cylinder, an air supply cam rotated by rotation of the crankshaft, the air supply push rod driven by the air supply cam and for opening and closing the air supply valve, an exhaust cam rotated by rotation of the crankshaft and an exhaust push rod driven by the exhaust cam and for opening and closing the exhaust valve.

8. An engine according to claim 5, wherein further comprising a cylindrical part having a sliding permission sealing portion in which said air supply push rod extends and is slidable liquid-tightly, wherein said piston member is provided on said air supply push rod; said fuel pump chamber is formed by an inner surface of said cylindrical part including said sliding permission sealing portion and said piston member; and said fuel suction hole and said fuel exhaust hole are provided on said cylindrical part in such a way that said fuel suction hole and said fuel exhaust hole communicate with said fuel pump chamber.

9. An engine according to claim 8, wherein said piston member is constructed of a cam follower provided at a lower end of said air supply push rod.

10. An engine according to claim 5, wherein said valve for the fuel return hole is installed at one side of the diaphragm, and said regulator has a spring for adjusting position of the valve is installed at the other side of the diaphragm.

11. An engine according to claim 5, wherein said valve for the fuel return hole has a base portion provided at a center portion of the diaphragm and a valve portion projecting from the base portion toward the fuel return hole, and said regulator has a spring contacting to the base portion of the valve for the fuel return hole and urging the base portion toward the fuel return hole.

12. An engine according to claim 5, wherein said engine is a model airplane engine.

13. An engine of a type in which an air supply valve of a cylinder is opened and closed by rotation of a crankshaft which is transmitted to an air supply cam and an air supply push rod, said engine comprising:

the cylinder having an air supply port;

a fuel injection device provided on the air supply port of the cylinder;

a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod, a lead valve for opening said fuel suction hole when the inside of said fuel pump chamber has the depressurized state, and a lead valve for opening said fuel exhaust hole when the inside of said fuel pump chamber has the pressurized state;

a pipe connecting said fuel suction hole of said fuel pump and a fuel supply source to each other;

a pipe connecting said fuel exhaust hole of said fuel pump and said fuel injection device to each other;

a cylindrical part having a sliding permission sealing portion in which said air supply push rod extends and is slidable liquid-tightly, and wherein said piston member is provided on said air supply push rod; said fuel pump chamber is formed by an inner surface of said cylindrical part including said sliding permission sealing portion and said piston member; and said fuel suction hole and said fuel exhaust hole are provide on said cylindrical part in such a way that said fuel suction hole and said fuel exhaust hole communication with said fuel pump chamber.

14. An engine according to claim 13, wherein further comprises an air supply valve provided on the air supply port of the cylinder, an exhaust port provided on the cylinder, an exhaust valve provided on the exhaust port of the cylinder, a piston for cylinder, an air supply cam rotated by rotation of the crankshaft, the air supply push rod driven by the air supply cam and for opening and closing the air supply valve, an exhaust cam rotated by rotation of the crankshaft and an exhaust push rod driven by the exhaust cam and for opening and closing the exhaust valve.

15. An engine according to claim 14, wherein said piston member sets the inside of said fuel pump chamber to the pressurized state when said air supply push rod operates and said air supply valve opens.

16. An engine according to claim 13, wherein said piston member is constructed of a cam follower provided at a lower end of said air supply push rod.

17. An engine according to claim 13, wherein said engine is a model airplane engine.

18. An engine of a type in which an air supply valve of a cylinder is opened and closed by rotation of a crankshaft which is transmitted to an air supply cam and an air supply push rod for an air supply valve, said engine comprising:

a crankcase having an air supply pipe;

the cylinder having an air supply port including an air-feeding pipe connected to an inside of said crankcase;

a fuel injection device provided on the air supply port of the cylinder;

a fuel pump having a fuel pump chamber, a fuel suction hole and a fuel exhaust hole both communicating with said fuel pump chamber, a piston member for setting an inside of said fuel pump chamber to a pressurized state and a depressurized state according to a movement of said air supply push rod for said air supply valve, a lead valve for opening said fuel suction hole when the inside of said fuel pump chamber has the depressurized state, and a lead valve for opening said fuel exhaust hole when the inside of said fuel pump chamber has the pressurized state;

a pipe connecting said fuel suction hole of said fuel pump and a fuel supply source to each other;

a pipe connecting said fuel exhaust hole of said fuel pump and said fuel injection device to each other; and a fuel supply regulator provided on said fuel supply pipe and having a diaphragm partitioning an inside of said fuel supply regulator into a primary side communicating with a fuel inflow port, a fuel outflow port, and a fuel return hole and a secondary side communicating with an inside of said crankcase or an inside of said air-feeding pipe and moving when there is a pressure fluctuation at said secondary side; and a valve, for said fuel return hole, capable of adjusting an open degree of said fuel return hole owing to a movement of said diaphragm in such a way that the higher a pressure at said secondary side, the lower the open degree of said fuel return hole becomes, a cylindrical part having a sliding permission sealing portion in which said air supply push rod extends and is slidable liquid-tightly, and wherein said piston member is provided on said air supply push rod; said fuel pump chamber is formed by an inner surface of said cylindrical part including said sliding permission sealing portion and said piston member; and said fuel suction hole and said fuel exhaust hole are provided on said cylindrical part in such a way that said fuel suction hole and said fuel exhaust hole communication with said fuel pump chamber.

19. An engine according to claim 18, wherein when a pressure at said secondary side is higher than that of said primary side by more than a predetermined value, said fuel return hole is close by said valve for said fuel return hole.

20. An engine according to claim 18, wherein further comprises an air supply valve provided on the air supply port of the cylinder, an exhaust port provided on the cylinder, an exhaust valve provided on the exhaust port of the cylinder, a piston for the cylinder, an air supply cam rotated by rotation of the crankshaft, the air supply push rod driven by the air supply cam and for opening and closing the air supply valve, an exhaust cam rotated by rotation of the crankshaft and an exhaust push rod driven by the exhaust cam and for opening and closing the exhaust valve.

21. An engine according to claim 18, said piston member sets the inside of said fuel pump chamber to the pressurized state when said air supply push rod for said air supply valve operates and said air supply valve opens.

22. An engine according to claim 18, wherein said piston member is constructed of a cam follower provided at a lower end of said air supply push rod.

23. An engine according to claim 18, wherein said valve for the fuel return hole is installed at one side of the diaphragm, and said regulator has a spring for adjusting position of the valve is installed at the other side of the diaphragm.

24. An engine according to claim 18, wherein said valve for the fuel return hole has a base portion provided at a center portion of the diaphragm and a valve portion projecting from the base portion toward the fuel return hole, and said regulator has a spring contacting to the base portion of the valve for the fuel return hole and urging the base portion toward the fuel return hole.

25. An engine according to claim 18, wherein said engine is a model airplane engine.

* * * * *